United States Patent [19]

Niki et al.

[11] Patent Number: 4,578,307

[45] Date of Patent: Mar. 25, 1986

[54] NONWOVEN SHEET HAVING IMPROVED HEAT DETERIORATION RESISTANCE AND HIGH ELONGATION

[75] Inventors: Akira Niki, Osaka; Hirofumi Iwasaki, Ashiya, both of Japan

[73] Assignee: Asahi Kasei Kogyo Kabushiki Kaisha, Japan

[21] Appl. No.: 712,243

[22] Filed: Mar. 15, 1985

[30] Foreign Application Priority Data

Mar. 17, 1984 [JP] Japan ..... 59-50184
Mar. 17, 1984 [JP] Japan ..... 59-50185
Mar. 17, 1984 [JP] Japan ..... 59-50186

[51] Int. Cl.[4] ..... D04H 3/10; D04H 3/14; D04H 3/16

[52] U.S. Cl. ..... 428/288; 28/112; 156/167; 156/181; 156/296; 428/296; 428/297; 428/395

[58] Field of Search ..... 156/167, 181, 296; 428/213, 288, 296, 297; 28/112

[56] References Cited

U.S. PATENT DOCUMENTS 3,949,130 4/1976 Sabee et al. ..... 428/296
4,210,690 7/1980 Hartman et al. ..... 428/395
4,434,204 2/1984 Hartman et al. ..... 428/296

*Primary Examiner*—James C. Cannon
*Attorney, Agent, or Firm*—Finnegan, Henderson, Farabow, Garrett & Dunner

[57] ABSTRACT

Disclosed is a nonwoven sheet consisting of undrawn polyethylene terephthalate filaments of which an outer layer portion of a filament section has a higher orientation and higher crystallization than a center of the filament section, and nonwoven sheets produced by using the above-mentioned nonwoven sheet as an intermediate goods.

The above-mentioned undrawn polyethylene terephthalate filament are those in which the filaments have an elongation at breakage of at least 100%, a shrinkage in boiling water of at least 15%, the filament section is a circular section having a radius R, and the average refractive index n || (0) of the central portion of the filament section and the average refractive index n || (0.8) of the portion apart by 0.8 R from the center satisfy the following requirements:

$$n \parallel (0) \leqq 1.640 \text{ and } [n \parallel (0.8) - n \parallel (0)] \geqq 6 \times 10^{-3}.$$

A nonwoven sheet produced by heat-press-bonding or mechanically entangling a web produced from the above mentioned filament, a nonwoven sheet produced by heat setting the former nonwoven sheet, and a nonwoven sheet produced by heat shrinking after heat-press-bonding and mechanically entangling the former web have an improved heat deterioration and other specified properties. Therefore, the above mentioned nonwoven sheets have a superior ability when used in field requiring heat shrinkage, a field requiring heat molding, or a field for felt like goods, respectively.

21 Claims, 2 Drawing Figures

NONWOVEN SHEET HAVING IMPROVED HEAT DETERIORATION RESISTANCE AND HIGH ELONGATION

BACKGROUND OF THE INVENTION (1) Field of the Invention

The present invention relates to a nonwoven sheet composed of polyethylene terephthalate filaments. More particularly, the present invention relates to a nonwoven sheet having an improved heat deterioration resistance and a high elongation and also to a nonwoven sheet having specific properties, and prepared from the above-mentioned nonwoven sheet.

(2) Description of the Prior Art

A highly molecularly oriented, highly crystalline, drawn polyethylene terephthalate filament has a good heat resistance and a good dimension stability, and therefore, filaments of this type are widely used for clothing and industrial materials. However, since the filaments have a low elongation at break point, they cannot be used in fields where a post processing such as molding is required.

Undrawn polyethylene terephthalate filaments have a high elongation at break point and a high heat shrinkability are known, and these filaments can be subjected to a post processing such as molding in the form of nonwoven sheets. Accordingly, these filaments can be applied in various fields. However, these undrawn polyethylene terephthalate filaments are subject to heat deterioration, in that their elongation at break point is reduced when they are heated.

Accordingly, although the commercial possibilities for undrawn polyethylene terephthalate filaments are broad, they are used only in limited specialized fields. For example, undrawn polyethylene terephthalate filaments are used as binder filaments for nonwoven sheets by utilizing the low softening point thereof (see Japanese Examined Patent Publication (Kokoku) No. 48-41115 and Japanese Unexamined Patent Publication (Kokai) No. 57-139554), or undrawn polyethylene terephthalate filaments are used for obtaining nonwoven sheets having an improved drape characteristic by preparing a nonwoven sheet while mixing drawn filaments with the undrawn filaments and drawing the nonwoven sheet by utilizing the high elongation of the undrawn filaments in the nonwoven sheet (see Japanese Examined Patent Publication No. 45-6296).

Under the above-mentioned background, we carried out research into the micro-structures of polyethylene terephthalate filaments with a view to improving the heat deterioration resistance, and as a result, found that the heat deterioration resistance can be improved if the outer layer portion of the section of a single filament is more highly oriented and has a higher degree of crystallization than the central portion. It also was found that if a nonwoven sheet composed of undrawn polyethylene terephthalate filaments having a thus-improved heat deterioration resistance is subjected to an appropriate post processing treatment, the resulting nonwoven sheet composed of undrawn polyethylene terephthalate filaments can be applied to uses not heretofore expected. The present invention was completed based on these findings.

SUMMARY OF THE INVENTION

It is a primary object of the present invention to provide a nonwoven sheet having an improved heat deterioration resistance, a high elongation, and a high heat shrinkability.

A second object of the present invention is to provide a nonwoven sheet having the heretofore unknown properties described below by subjecting the above-mentioned nonwoven sheet to appropriate processing. Namely, the second object of the present invention is to provide a nonwoven sheet of polyethylene terephthalate filaments, in which fluffing or interlaminar peeling is not caused, which is readily elongated at high temperatures, and which has a low heat shrinkability.

A third object of the present invention is to provide a bulky nonwoven sheet of polyethylene terephthalate filaments having a high fiber density, a high elasticity, and an improved anisotropy of the elongation by an external force.

In accordance with the present invention, the first object can be attained by a nonwoven sheet composed of polyethylene terephthalate continuous filaments, wherein the filaments have a shrinkage in boiling water of at least 15%, the filament section is a circular section having a radius R, and the average refractive index $n_{\parallel}(0)$ of the central portion of the filament section and the average refractive index $n_{\parallel}(0.8)$ of the portion apart by 0.8R from the center satisfy the following requirements:

$$n_{\parallel}(0) \leqq 1.640 \text{ and } [n_{\parallel}(0.8) - n_{\parallel}(0)] \leqq 6 \times 10^{-3}.$$

This nonwoven sheet will be referred to as "YW type nonwoven sheet" hereinafter.

The second object of the present invention can be attained by a nonwoven sheet composed of polyethylene terephthalate filaments, which is formed from the above-mentioned YW type nonwoven sheet, wherein the polyethylene terephthalate filaments are partially heat-press-bonded to one another, the heat shrinkage at 150° C. is at most 5% and the elongation at break at 150° C. is at least 70%, and wherein the filaments have a circular section having a radius R, and the average refractive index $n_{\parallel}(0)$ of the central portion of the filament section and the average refractive index $n_{\parallel}(0.8)$ of the portion apart by 0.8R from the center satisfy the following requirements:

$$1.600 \leqq n_{\parallel}(0) \leqq 1.670 \text{ and } [n_{\parallel}(0.8) - n_{\parallel}(0)] \geqq 5 \times 10^{-3}.$$

This nonwoven sheet will be referred to as "YH type nonwoven sheet" hereinafter.

The third object of the present invention can be attained by a nonwoven fabric composed of polyethylene terephthalate filaments, which is formed from the above-mentioned YW type nonwoven sheet, wherein the polyethylene terephthalate filaments are mechanically entangled with one another by needle punching, the heat shrinkage at 150° C. is at most 5%, the filament density is such that the ratio of caught particles having a size larger than 15μ is at least 80%, and the elastic recovery is at least 50%, and wherein the filaments have a circular section having a radius R, and the average refractive index n (0) of the central portion of the filament section and the average refractive index $n_{\parallel}(0.8)$ of the portion apart by 0.8R from the center satisfy the following requirements:

$$1.600 \leqq n_{\parallel}(0) \leqq 1.670 \text{ and } [n_{\parallel}(0.8) = n_{\parallel}(0)] \geqq 5 \times 10^{-3}.$$

This nonwoven sheet will be referred to as "YN type nonwoven sheet" hereinafter.

DESCRIPTION OF THE PREFERRED EMBODIMENTS

Since the present invention concerns novel fibers or sheets having specific characteristics determined by special measurements, it may be helpful at this point to describe and define various characteristics and measurements that are used throughout this specification.

Sectional Shape of Constituent Filament:

The sectional shape of the constituent filament is of a tube circle, or it may be a flatened circle or an irregular circle having convexities and concavities, as long as the attainment of the objects of the present invention is not hindered thereby. By the term "circular section" used herein, is meant the ratio between the radius R1 and R2 of the circumscribed circle and inscribed circle of the cross-sectional shape is in the range of from 1.0 to 1.1 (R1=R2 in the case of a true circle). The radius R of the circular section is represented by (R1+R2)/2, and by the center of the circular section is meant the middle point of a line connecting the center of the circumscribed circle to the center of the inscribed circle.

Average Refractive Index n || or n⊥ and Average Birefringence:

The distribution of the average refractive index observed from the side face of the filament by the interference fringe method can be measured, for example, by using a transmission quantitative interference microscope (for example, INTERFARCO supplied by Karltwiesena Co., GDR). This method can be applied to filaments having a circular section.

The refractive index of a filament is characterized by a refractive index n || to a polarized light having an electric field vector parallel to the axis of the filament and a refractive index n⊥ to a polarized light having an electric field vector vertical to the axis of the filament.

Note, a green ray (having a wavelength λ of 549 mμ) is used in all measurements described herein.

The filament is immersed in a sealant inactive to the filament, which has a refractive index (N) giving an interference fringe deviation of 0.2 to 2 wavelengths, by using an optically flat slide glass and cover glass. Several filaments are immersed in the sealant in such a manner that the individual filaments are not in contact with one another. The filaments should be arranged so that the filament axis is vertical to the optical axis of the interference microscope and the interference fringe. The pattern of this interference fringe is photographed and the photo is enlarged to about 1500 magnifications and analyzed.

Figure 2:
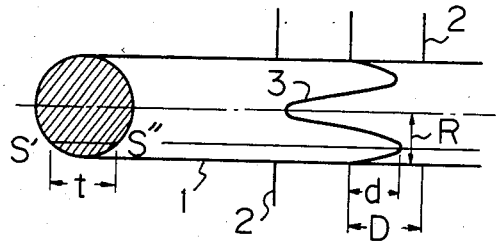

As shown in FIG. 2, the optical path difference Γ is represented by the following equation:

$$\Gamma = d/D \cdot \lambda = [n \parallel (or\ n\perp) - N]t$$

wherein N stands for the refractive index for the sealant n || (or n⊥) stands for the refractive index between points S' and S'' on the periphery of the filament, t stands for the thickness between the points S' and S'', λ stands for the wavelength of the used ray, D stands for the spacing in the parallel fringe of the background (corresponding to 1λ), and d stands for the deviation of the interference fringe by the filament.

Assuming that the radius of the filament is R, the distribution of the refractive indexes n || (or n⊥) of the filament at respective positions can be determined from the optical path differences at the respective points in the region of from the center Ro of the filament to the periphery R of the filament. Then, assuming that r is a distance to each position from the center of the filament, the refractive index where X=r/R=0, that is, the refractive index at the center of the filament, is designated as the average refractive index [n || (0) or n⊥(0)]. X is equal to 1 on the periphery of the filament, and X is in the range of 0 to 1 in other portions. For example, the average refractive index at the point of X=0.8 is expressed as n || (0.8)[ or n⊥(0.8)]. The difference of the average refractive index (n || ) between the inner and outer layers is expressed as n || (0.8)−n || (0). The average birefringence (Δn) is calculated from the average refractive indexes n || (0) and n⊥(0) according to the formula $\Delta n = n \parallel (0) - n\perp(0)$.

Shrinkage in Boiling Water (based on JIS L 1073):

The length Lo of a sample under a load of 0.1 g/d is measured, and the load is then removed and the sample treated in boiling water for 30 minutes. The length L of the sample is measured again under the same load. The shrinkage in boiling water is expressed as follows:

$$\text{Shrinkage (\%) in boiling water} = (LO - L)/LO \times 100$$

Strength and Elongation (based on JIS L 1096):

The strength and elongation are measured at a grip length of 10 cm and a pulling speed of 20 cm/min by using a universal tensile tester (Auto-Graph Model DSS-2000 supplied by Shimazu Seisakusho).

Tear Strength; pendulum method (based on JIS L 1096):

Three test pieces having a size of 6.5 cm×10 cm are collected in the longitudinal direction and three test pieces having the same size are collected in the lateral direction. The maximum load is measured when the test piece is torn by an Elmendorf tear tester, and the average value is calculated and expressed in either the longitudinal direction or the lateral direction.

Abrasion Resistance (based on JIS L 0823):

A test piece having a size of 20 cm (length)×3 cm (width) is abraded 100 times reciprocatively under a load of 500 g by an abrasion tester Model II (Gakushin type), and the change of the appearance is examined and evaluated as an abrasion resistance according to the following scale.

Grade A: no fluff

Grade B: some fluff but not conspicuous

Grade C: conspicuous fluff

Weight per unit area (based on JIS L 1096):

A test piece having a size of 20cm×20 cm is weighed and the weight per unit area is calculated.

Thickness (based on JIS L 1096):

The thickness is measured at three points or more by using a dial gauge having a load of 100 g/cm$^2$, and the thickness is expressed by the average value.

Bulkiness (based on JIS L 1096):

The volume per unit weight is calculated from the above-mentioned weight and thickness, and the bulkiness is expressed by the obtained value.

Rigidity and Softness (based on JIS L-1079A):

The rigidity and softness are determined as a factor indicating the touch according to the 45° cantilever method.

Elastic Recovery (based on JIS L-1096):

Test pieces having a size of 3 cm and 20 cm are collected in both the longitudinal direction and the lateral direction. By using a constant speed elongation type tensile tester, a certain load of 2.0 Kg/3 cm is imposed for 1 minute at a grip distance of 10 cm and a pulling speed of 10 cm/min. When 5 minutes have passed from the point of removal of the load, the elastic recovery is determined from the dimensional change of the test piece. Namely, the elastic recovery is calculated according to the following formula:

$$\text{Elastic recovery} = l2/l0 \times 100\ (\%)$$

wherein l0 stands for the length before imposition of the load, l1 stands for the length under the load, and l2 stands for the length after removal of the load.

Heat Shrinkage (based on JIS L-1042):

A test piece having a size of 25 cm×25 cm is sampled, and points 20 cm in both the longitudinal direction and the lateral direction are marked. The test piece is placed in a hot air drier maintained at 150° C. for 5 minutes, and the percentage of shrinkage is determined from the change in the dimension. An average value is calculated and expressed.

Heat Deterioration:

(1) Heat Distortion under Exposure to High Temperature for a Long Time (HR-1)

Ten filaments having a length of 30 cm are sampled from a web and are treated under constant length at 160° C. for 5 minutes in a hot air drier. Five of the heat-treated filaments are subjected to the tensile test and the average value L1 of the elongation at break is determined. The remaining 5 filaments are allowed to stand in a hot air drier at 150° C. for 300 hours and are then subjected to the same tensile test, and the average value L2 of the elongation at break is determined. The elongation retention ratio, that is, L2/L1×100, is calculated as a criterion of the heat deterioration.

(2) Heat Distortion by Contact with a Heated Body (HR-2)

A bundle of ten filaments prepared as in the above item (1), or a sample web, is passed for heat-compression between a pair of smooth metal rolls heated at 150° C. under a linear pressure of 20 Kg/cm, and the surface speed of the heat rolls is 10 m/min, and the strength and elongation are then measured. The retention ratio of the elongation at break after the heat-compression contact is calculated as a criterion of the heat deterioration in the same manner as described above with respect to HR-1.

Dust Catching Ratio

Two kinds of dust particles (siliceous sand) specified in JIS Z-8901 (testing dusts) are uniformly dispersed at a concentration of 100 mg/m$^3$ under an air feed rate of 1 m$^3$/min, and by using a tester shown in FIG. 3 of JIS C-9615 (air cleaner), the test is carried out over the range of from the aeration resistance ($\Delta p1$) to the two-fold aeration resistance ($\Delta p2$) and the dust catching ratio is calculated according to the following formula:

$$\text{Dust catching ratio} = w2/w1 \times 100\ (\%)$$

wherein w1 stands for the amount of dust particles used and w2 stands for the amount of dust particles caught.

Anisotropy

Five specimens having a size of 3 cm×20 cm are sampled in the longitudinal direction and another five specimens having the same size are sampled in the lateral direction. With respect to each direction, the average strength at break is determined at a grip distance of 10 cm and a pulling speed of 20 cm/min by a constant speed elongation type tensile tester. The direction in which the average value is larger is designated as D1, and the direction at a right angle thereto is designated as D2. In the obtained stress-strain curves (each having 5 measurement sample) in both the directions, average values $\sigma_{D1}$ and $\sigma_{D2}$ of stresses at elongations of 10, 20, and 30%, are determined, and the anisotropy is evaluated based on the value $\sigma_{D1}/\sigma_{D2}$. The larger this value, the higher the anisotropy.

A detailed description of the preferred embodiments will now be given with reference to the accompanying drawings.

The polyethylene terephthalate filaments employed in the first embodiment, i.e., the embodiment for the YW type nonwoven sheet, the second embodiment, i.e., the embodiment for the YH type nonwoven sheet, and the third embodiment, i.e., the embodiment for the YN type nonwoven sheet, are produced by spinning a material produced through a well-known polymerization process, and may contain additives added ordinarily to polyethylene terephthalate, such as a delustering agent, an antistatic agent, a flame retarder, and a pigment. The degree of polymerization is not limited to any particular value, so long as the degree of polymerization is within an ordinary range of polymerization degree for producting filament. Further it is possible to use copolymer with another component so long as the object of the present invention is achieved, and a small quantity of another polymer, e.g., polyamide, polyolefin or the like may be blended therein.

In the descriptions regarding the YH type nonwoven sheet and the YN type nonwoven sheet, the nonwoven sheet in which the undrawn polyethylene terephthalate filament having the property defined in each claim is used as the total material, is described. However nonwoven sheet in which the undrawn polyethylene terephthalate filaments according to the present invention are blended or plied as the state of nonwoven web with other polyethylene terephthalate filaments produced by a different draw ratio or another filament, e.g., polyamide filament, polyolefin filament or the like, may be included as long as each afore-mentioned object of the present invention is achieved.

The first embodiment for the YW type nonwoven sheet is described hereinafter.

A feature of the filaments constituting the nonwoven sheet according to the first embodiment is that the filaments have a construction satisfying the following requirements in the filament section.

(A) $n \parallel (0) \leqq 1.640$ (B) $\{n \parallel (0.8) - n \parallel (0)\} \geqq 6 \times 10^{-3}$ The filament having the above construction is highly molecularly oriented and highly crystallined in the outer layer portion of the filament, and the center portion, is lower molecularly oriented and lower crystallined compared with the outer layer portion of the filament. Therefore, this filament is an undrawn polyethylene terephthalate filament having a two ply construction. Further the filament having the two ply construction according to the present invention has a substantially circular cross section and the orientation and the crystallinity thereof gradually increase from the center portion to the outer layer portion.

In the first embodiment, the above requirement (B) must be satisfied to improve the heat deterioration of the filament. However, if the requirement (B) is satisfied but the requirement (A) is not satisfied, i.e., the value of n || (0) is over 1.640, a filament having a high elongation cannot be obtained, and accordingly, a nonwoven sheet made of such filaments has a low elongation. Note, when the value of n || (0) becomes too small, it becomes difficult to improve the heat deterioration of the filaments. Therefore, the preferable range of n || (0) is "$1.580 \leqq n \parallel (0) \leqq 1.630$", when, even if the requirement (A) is satisfied, the value of $\{n \parallel (0.8) - n \parallel (0)\}$ is less than $6 \times 10^{-3}$, the filaments are easily deteriorated. In the filaments of the present invention, a greater improvement in the heat deterioration appears when the value of $\{n \parallel (0.8) - n \parallel (0)\}$ is large. To obtain filaments having an improved heat deterioration resistance and high elongation, it is necessary that the filaments satisfy the requirements (A) and (B), and that they have shrinkage factor in boiling water of at least 15%, preferably 20%. In practice, the upper limit of shrinkage factor in boiling water is 70%, however, filaments having a shrinkage factor in boiling water of over 70% may be used.

As described hereinbefore, the heat deterioration expressed in the first invention means deterioration of the elongation of the filaments after exposing the filaments to a high temperature atmosphere for a long period of time or after placing the filaments in contact with a heat source, and heat shrinkage means a shrinking ratio in boiling water.

The high elongation expressed in the first invention means that an elongation at a break point of the filaments constituting the nonwoven sheet is over 100% and that the elongation at a break point of a nonwoven sheet of the first invention formed by providing partially heat-press-bonding portions or by mechanically entangling the filaments with one another is over 70%, preferably over 100%. An upper limit of the elongation at a break point is practically 300%, however, a filament or a nonwoven sheet having an elongation at a break point of over 300% may be used.

Another feature of the filaments comprising the nonwoven sheet according to the first embodiment is that the average refractive indexes at every point of a filament section are symmetrically distributed about a center of the cross section of the filament. That is, a relationship between the average refractive index n || (0) of the central portion of the filament section and the average refractive index n || (0.8) of the portion apart by 0.8R from the center is a minimum value of the average refractive index n || is at least $(n \parallel (0) - 10 \times 10^{-3})$ and a difference between the average refractive index n || (0.8) and n || (−0.8) is at most $10 \times 10^{-3}$, preferably $5 \times 10^{-3}$. Note, values of n || (0), n || (0.8), n || (−0.8) and Δn were measured by using the interference microscope on the basis of the method described hereinbefore.

The nonwoven sheet according to the first embodiment is the nonwoven sheet in which the filaments are restrained by partially heat-press-bonding a web formed from the filaments by means of a pair of embossing roll or the like, or by mechanically entangling the web formed from the filaments by means of a needle-punching device or the like.

The fineness of the constituent filament constructing the nonwoven sheet according to the first invention is at most 30 denier, preferably 0.5 to 15 denier. The nonwoven sheet may be formed of constituent filaments having the same fineness or formed of constituent filaments having a different fineness in a blended state. The weight per unit area of the nonwoven sheet is preferably in the range between 10 g/m$^2$ and 500 g/m$^2$, but this range is not usually particulars defined.

A typical method for producing the nonwoven web used for the nonwoven sheet according to the first embodiment will now be described with reference to FIG. 1.

A filament group 17 extruded from a spinning nozzle 12 arranged on a spinblock is drawn by a high speed air current ejected from a pressure air chamber 19 of an air suction device 18 and is accumulated on a conveyer net 20 moving in the direction shown by an arrow in the drawing and provided with air suction duct 22 below to form a web 21. The filament group 17 passes through an air-cooling chamber 13 arranged below the spinning nozzle 12 and is cooled from outside of the filament. Then the polyethylene terephthalate filaments used in the nonwoven sheet according to the first embodiment are formed. As shown in FIG. 1, the air-cooling chamber 13 is rotatably supported by an air-blowing-angle-changing lever 16 and a plurality of stream regulating plates 14 are provided near a cooling air outlet 15, therefore the cooling air blowing downward can be applied to the filament group 17 at a predetermined angle against the direction of the advance of the filament group.

That is, it is necessary to satisfy the following condition for obtaining undrawn polyethylene terephthalate filaments having a two layer construction according to the present invention.

(1) The drawing process should be taken in relatively short lengths directly after the spinning. In practice, the distance between the spinning nozzle 12 and the air suction device 18 is at most 1000 mm, preferably, 800 mm.

(2) Cooling air having a temperature of at most 20° C., preferably, 15° C., is blown from outside of the filament group to the filament group at a speed of at least 0.5 m/sec in an area located within 400 mm directly below the spinning chamber.

The length L of the cooling air blowing out zone may be, for example, 70 mm, and the blowing angle $\theta$ toward the filament group may be, for example, 35°. To make the distribution of the average refractive index at the every point of the filament section symmetrical about the center of the cross section of filament, it is necessary to uniformly blow out the cooling air on both sides of the filament group so that the outer filaments are near to the cooling air and the center filaments are remote from the cooling air, and yet both are cooled at the same level.

As described hereinbefore, the filaments constituting the nonwoven sheet according to the first embodiment are formed into filaments having a two layer construction because the filaments are suddenly drawn directly after spinning and the outer layer portion of the section of the single filaments is more highly oriented and has a higher degree of crystallization than the central portion.

In addition to the above condition, it is necessary to suitably select the spinning speed, exhaust amount, air blowing amount, diameter of the spinning nozzle, number of holes in the spinning nozzle, or the like, at the time of producing the nonwoven sheet according to the first embodiment. For example, when the cooling effect is insufficient and is biased about the center of cross section of the single filament, it is impossible to obtain a stable two layer construction as defined by the present invention.

The nonwoven sheet according to the first embodiment is formed by applying a partial heat-press-bonding process, mechanical entangling process, or the like, to the web constitued from the above described polyethylene terephthalate filaments.

In the first embodiment, to produce a nonwoven sheet provided with partial bonding portions applied by the heat-press-bonding process, the web is heat-press-bonded by means of a pair of embossed rolls having a convex and concave pattern on a surface of at least one roll, and the temperature of the heat rolls is 70° to 130° C., preferably 90°~120° C., the line pressure between the heat rolls is 5~90 Kg/cm, preferably, 20~70 Kg/cm, and the surface speed of the heat rolls is 2~100 m/min. To accomplish the object of the first embodiment, it is important to partially apply the heat-press-bonding to the web rather than applying the heat-press-bonding all over the web. Note, the area ratio of partial heat-press-bonding is preferably 5~50%.

Whereas, to produce a nonwoven sheet according to the first embodiment, having a reinforced entanglement between each fiber made by a needle punching process, the web is punched in a known manner, and the repeat punching is carried out at 50 to 400 punches per $cm^2$.

The nonwoven sheet produced by the process described hereinbefore is constituted from undrawn polyethylene terephthalate filaments having a two layer construction, therefore heat deterioration of the sheet is improved, and the sheet has the features which are essentially part of the undrawn polyethylene terephthalate filaments, i.e., high elongation and heat shrinkage properties. Therefore the nonwoven sheet according to the first embodiment can be used in fields where various heat molding processes are required.

Further, the softening point of the nonwoven sheet according to the first embodiment is essentially low, and since the sheet is formed by press-bonding or mechanical entangling, and the undrawn polyethylene terephthalate filaments have a high elongation the tear strength of the sheet is high. Therefore, when the nonwoven sheet according to the first embodiment is used as a shrinkable packing material, a shrinkable molding material, a hand craft material having a crimping property, or the like, the nonwoven sheet has excellent properties. Further, since this nonwoven sheet has a high elongation, the sheet can be widely applied to an extendable molding material, an extendable packing material, an impact absorbing material, medical goods, or the like.

The second embodiment for the YH type nonwoven sheet is described hereinafter.

As described hereinbefore, since the heat deterioration of the YW type nonwoven sheet according to the first embodiment is low and this sheet has a heat shrinkable property, the sheet can be used as various shrinkable packing materials or molding materials.

However, recently, a material having further improved properties, e.g., a molding material in which fuzzing and exfoliation between layers of the sheet do not easily occur, which can be easily stretched under a high temperature, and has a low heat shrinkage property, is required. This is because fields in which a heat molding process is used have expanded, and the heat molding process is usually intended to be applied to molding products requiring a large transformation. When applying a heat molding process in which a large transformation occurs, for example, the microstructure of a nonwoven sheet must not be destroyed, even if the sheet is stretched by at least 50%. Further, it is necessary that the sheet does not shrink during the heat moulding process. That is, a nonwoven sheet which can be easily stretched and does not shrink when heated is required as a nonwoven sheet capable of producing molding products in which a large transformation occurs. Further, it is necessary that a molding product formed by heat molding the nonwoven sheet has little fuzzing on the surface thereof and that exfoliation between the layers of sheets does not occur. The YW type nonwoven sheet described hereinbefore cannot sufficiently satisfy the above mentioned requirements.

The above mentioned requirements are satisfied by a YH type nonwoven sheet according to the second embodiment of the present invention.

A feature of the filaments comprising this nonwoven sheet is that the filaments have a construction satisfying the following requirements in the filament section.

(A) $1.600 \leqq n \parallel (0) \leqq 1.670$ (B) $\{n \parallel (0.8) - n \parallel (0)\} \geqq 5 \times 10^{-3}$.

If item (B) is satisfied, the filament is highly molecularly oriented and highly crystallined in an outer layer portion of the filament, and a center portion is less molecularly oriented and less crystallized compared with the outer layer portion of the filament. Therefore, the crystallization and the orientation in the filament is gradually increased from the center portion to the outer layer portion.

Another feature of the filaments comprising the YH type nonwoven sheet is that the partial distribution of the average refractive index is symmetrical about a center of the filament.

The formation of the filament structure contributes to an improvement of the heat deterioration. The heat deterioration in relation to the second embodiment means a drop in strength and an elongation at a breakage point caused by contact in a pressed and heated state with a heat source, e.g., a metal die in a heat molding process.

When $n \parallel (0)$ of the filament comprising the nonwoven sheet according to the second embodiment is at most 1.600, the nonwoven sheet becomes brittle and the object of the second embodiment is not achieved. Further when $n \parallel (0)$ is over 1.670, a nonwoven sheet having a large elongation at break point cannot be obtained. If the above requirement (B) is not satisfied and the above requirement (A) only is satisfied, though the nonwoven sheet having a high elongation at breakage when heated, which is one of the objects of the present invention, is obtained, this nonwoven sheet has a tendency to be easily deteriorated by heat. In the second embodiment, when the value of requirement (B) becomes large, the orientation and crystallization of the outer layer portion of the filament become large, and thus the heat deterioration is strongly improved.

To make the partial distribution of the average refractive index symmetrical about the center of filament, it is necessary that a relationship between the average refractive index n || (0) of the central portion of the filament section and the average refractive index n || (0.8) of the portion apart by 0.8R from the center is a minimum value of the average refractive index n || is at least (n || (0) − $10\times10^{-3}$), and a difference between the average refractive index n || (0.8) and n || (−0.8) is at most $10\times10^{-3}$, preferably $5\times10^{-3}$. The heat deterioration of the filament does not easily occur and a uniformity of strength and elongation at breakage become small by making the partial distribution of the average refractive index symmetrical about the center of filament.

A nonwoven sheet according to the second embodiment is comprised of polyethylene terephthalate filaments having the microscopic structure described hereinbefore, and is formed by bonding the filaments together by means of partial heat-press-bonding. The features of this nonwoven sheet are that the shrinkage ratio of the nonwoven sheet is at most 5% at a temperature of 150° C. and the elongation at breakage is at least 70% at a temperature of 150° C.

A typical method for producing the YH type nonwoven sheet according to the second embodiment will now be described. The nonwoven sheet according to the second embodiment is formed by heat setting the nonwoven sheet according to the first embodiment, i.e., the nonwoven sheet produced by applying the partial heat-press-bonding to the web, in a high temperature atmosphere. This heat setting process is necessary to increase the crystallization of molecules. Further it is necessary that the feature of the filaments constituting the nonwoven sheet according to the second invention, i.e., the difference between the average refractive indexes of the outer layer portion and the center portion of the filament section, is substantially maintained at the same level.

In the second embodiment, heat setting is performed at 180° C. for 20 sec., for example, by means of a tenter machine. The n || (0) of the filament constituting the nonwoven sheet according to the first embodiment is more crystallized by the heat so that the value of n || (0) becomes higher. Accordingly, a range of n || (0) of the filament in the nonwoven sheet according to the second embodiment becomes $1.600 \leqq n \parallel (0) \leqq 1.670$.

The filaments constituting the nonwoven sheet according to the second embodiment produced by the method described hereinbefore have a construction in which the center portion of the filament section has a low crystallization and the outer layer portion of the filament section has a high crystallization and a high orientation, and thus the heat deterioration of this nonwoven sheet is improved. Further, heat shrinkage of the nonwoven sheet is improved by heat setting. The nonwoven sheet constituted of the undrawn polyethylene terephthalate filament having the filament construction according to the present invention is a novel nonwoven sheet which can prevent heat deterioration during the post heating process, maintain the high stretch property which is a characteristic of undrawn filaments, and eliminate the heat shrinking property which is a disadvantage of undrawn filaments. In the nonwoven sheet according to the second embodiment, fuzzing and construction destruction such as exfoliation between the layers does not easily occur when the nonwoven sheet is stretched during the heat molding process, because the filaments are firmly bonded together by the partial heat-press-bonding and heat setting.

As a result, the nonwoven sheet according to the second embodiment can be used as various molding materials, e.g., as a hat material, as an inside tray of a box for cosmetics or the like, as shoes, as a core cloth for a bag, and as an interior material for a motorcar, or the like.

The third embodiment for the YN type nonwoven sheet is described hereinafter.

The nonwoven sheet has many end uses. However it has been hitherto impossible to obtain a nonwoven sheet having a bulkiness and an improved anisotropy of an elongation against a force applied from an outside from a nonwoven sheet made of filaments such as a spun bond type nonwoven sheet. This third embodiment is intended to provide a nonwoven sheet having the above-mentioned feature and produced by using the nonwoven sheet having an improved heat deterioration.

In general, the spun bond type nonwoven sheet having the properties by which is either easily stretchable or unstretchable in two directions, i.e., a lengthwise direction and a widthwise direction of the nonwoven sheet, is preferable because of a corresponding ability for various end uses. Whereas, a nonwoven sheet which is easily stretchable in either one direction, i.e., a lengthwise direction or a widthwise direction of the nonwoven sheet, but is not stretchable in any other direction, is not suitable except for a specified end use. Recently, a nonwoven sheet having a fine structure and a good elasticity, and being stretchable in both the lengthwise direction and the widthwise direction is strongly required. Further, a nonwoven sheet which, when a force applied from outside of the nonwoven sheet is relatively small, is not easily stretched (the Young's modulus is large), and when a relatively large force, such as an outside force applied during the molding process or the like, is applied, is easily stretched by a similar amount in both directions, is especially required.

Various ways of providing the above mentioned property to the nonwoven sheet made of filaments have been proposed. For example, a nonwoven sheet in which a sticking type composite filament made of a polyester polymer and a polyester copolymer is used as a filament having a potential crimp, a web formed from the above mentioned filaments is applied with a needle punching process to make a nonwoven sheet, and the filaments in the nonwoven sheet are crimped during a heat treatment is known. Although the bulkiness of the nonwoven sheet is increased, however this nonwoven sheet is easily stretched by an outside force and the improvement of the anisotropy of the elongation is not sufficient.

A nonwoven sheet in which a web is produced from well-known undrawn polyethylene terephthalate filaments, the needle punching treatment is applied to the web to make a nonwoven sheet, and a heat treatment is applied to the nonwoven sheet so as to shrink the nonwoven sheet, is known. The nonwoven sheet of this case has a fine structure caused by shrinkage of the filaments, but has a hard handling because the filaments become hard.

The inventors of the present invention studied ways to improve the draw backs of the nonwoven sheet consisting of the above-mentioned undrawn polyethylene terephthalate filaments, i.e., the hardness of handling of the nonwoven sheet caused by the hardening of the filaments during the heat shrinkage process and the heat deterioration occurring when the nonwoven sheet is in contact with a high temperature source, and obtained a nonwoven sheet satisfying the object of the third embodiment. As the result of the foregoing study, the inventors found that the above-mentioned object can be accomplished by making the crystallization and the orientation in the outer layer portion of the filament section consisting of the undrawn polyethylene telephthalate larger than that in the center portion of the filament section, and thus the third embodiment was attained.

A feature of the filaments comprising the nonwoven sheet according to the third embodiment and satisfying the above-mentioned term, i.e., the YN type nonwoven sheet, is that the filaments have a construction satisfying the following requirements in the filament section, as for the filaments comprising the YH type nonwoven sheet according to the foregoing second embodiment (A) $1.600 \leqq n \parallel (0) \leqq 1.670$ (B) $\{n \parallel (0.8) - n \parallel (0)\} \geqq 5 \times 10^{-3}$.

Another feature of filaments comprising the YN type nonwoven sheet is that the partial distribution of the average refractive index is symmetrical about a center of the filament. An explanation regarding the property of this filament will be omitted, since it has been given in detail for the first and second embodiments.

The nonwoven sheet according to the third embodiments obtained by applying a needle punching treatment to a nonwoven sheet according to the first embodiment, and a heat shrinkage treatment is applied to the above nonwoven sheet to increase the degree of entanglement of the filaments. In general, the degree of entanglement before the heat shrinkage treatment is not sufficient to satisfy the object of the third embodiment, i.e., the degree of entanglement giving a construction having a sufficient density of the filaments, because the nonwoven sheet in this state is obtained by two dimensional distribution of the filaments formed at the time of forming a web is only enhanced to increase the entanglement between the filaments in a third dimensional state by means of the needle punching treatment. The nonwoven sheet according to the third invention is obtained by eliminating or decreasing air gaps within the construction consisting of a plurality of filaments by applying a heat shrinkage treatment to the needle punched nonwoven sheet so that the density of the filaments is increased and a nonwoven sheet having a fine construction is produced. Consequently, in the nonwoven sheet according to the third embodiment, the filament density is such that the ratio of caught particles having a size larger than 15μ is at least 80%, and the elastic recovery is at least 50%.

The nonwoven sheet according to the third embodiment has another feature in which the anisotropy of the elongation is increased by the heat shrinkage treatment. The value of the anisotropy in the nonwoven sheet according to the third embodiment is 0.8 to 3.0, preferably, 1.0 to 2.0, for the range of elongation of the nonwoven sheet of 10% to 30%.

A typical method for producing the YN type nonwoven sheet according to the third embodiment will now be described.

The nonwoven sheet according to the third embodiment is produced by applying a heat shrinkage treatment to a nonwoven sheet prepared by applying an entangling treatment including at least a needle punching treatment to the nonwoven sheet according to the first embodiment. It is preferable to heat-press-bond the nonwoven sheet at a temperature of at most 100° C. by embossed rolls provided with convex portions on the surface thereof to prevent disturbance of the web before the needle punching treatment. But this heat-press-bonding may be omitted. The needle punching may be performed by a known manner in which operational condition thereof is not limited, however, the number of punches per unit area is usually at least 50 puches/cm$^2$, preferably, 100 punches/cm$^2$, most preferably, 500/cm$^2$. The heat shrinkage treatment for the punched nonwoven sheet should be carried out at a temperature of between 70° C. and 200° C., preferably, between 100° C. and 180° C., and at a treatment time of at most 60 sec.

The average refractive index $n \parallel (0)$ of the filament comprising of the heat shrunk nonwoven sheet must satisfy the following requirement, $$1.600 \leqq n \parallel (0) \leqq 1.670$$

When $n \parallel (0)$ is at most 1.600, the obtained nonwoven sheet becomes brittle, and when $n \parallel (0)$ is at least 1.670, a nonwoven sheet having a large elongation at breakage cannot be obtained.

The nonwoven sheet is shrunk at least 5%, preferably 10 to 50%, in both the lengthwise direction and the widthwise direction by a tender machine, a cylinder, a loop dryer or the like. After that, if necessary, a spreading treatment for the nonwoven sheet or a smoothing treatment for the surface thereof is performed at a temperature of less than 150° C. Further, an embossing treatment at a temperature of at least 150° C. may be applied to the heat shrank nonwoven sheet to make patterns on the surface of the nonwoven sheet. Since the nonwoven sheet according to the third embodiment has small heat shrinkage and low heat deterioration, it is possible to apply the spreading treatment, the smoothing treatment and the embossing treatment or the like to the nonwoven sheet.

The YN type nonwoven sheet according to the third embodiment produced by the method described hereinbefore is comprised of filaments having a low crystallization in the central portion of the filament section and a high crystallization and high orientation in the center layer portion of the filament section. Therefore, hardening and heat deterioration of the nonwoven sheet does not occur when the nonwoven sheet is heat shrunk. Further, since the nonwoven sheet according to the third embodiment is produced by shrinking the nonwoven sheet in the state in which the filaments are rearranged from a two dimensional arrangement to a three dimensional arrangement by a mechanical entangling treatment, this nonwoven sheet has a good bulkiness and a high filament density. As a result, in this construction the dimensions of the air gaps between the filaments and the amount thereof become very small, the elastic recovery of the nonwoven sheet is improved, and the anisotropy of elongations in the lengthwise direction and the widthwise direction is also improved.

Since the YN type nonwoven sheet according to the third embodiment is constituted as described hereinbefore, this nonwoven sheet can be used as a replacement for felt, and thus this nonwoven sheet can be used as, for example, a hat material, carpeting, wall material, base cloth of an artificial leather, padding cloth for apparel, and the interior of an automobile, or the like.

EXAMPLES

A. In the following, two examples and four reference examples regarding polyethylene terephthalate filaments constituting the YW type nonwoven sheet according to the first embodiment were prepared, and the various properties thereof compared.

A polyethylene terephthalate having an intrinsic viscosity of 0.75 is extruded at a temperature of 290° C. and an extruding rate of 850 g/min by means of a rectangular spinning nozzle having 1000 holes with a diameter of 0.25 mm. Then various filaments are produced by changing the spinning speed and the distance (designated H.D) between the spinning nozzle and an air suction device used for drawing the filaments, and the filaments are collected on a metal net to make a web.

Figure 1:
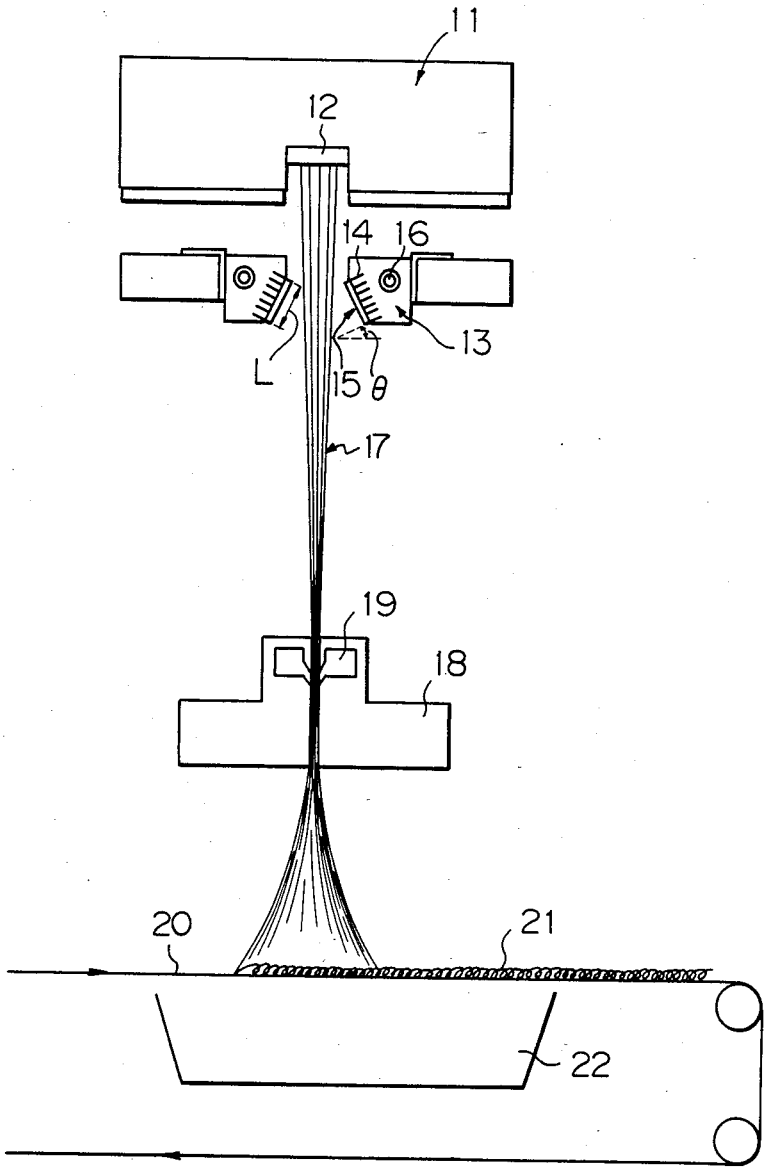
FIG. 1 is an outline diagram of an example of the apparatus for producing the nonwoven web of the present invention; and, FIG. 2 is a diagram showing an example of the interference fringe used for determination of the distribution of the refractive index (n || or n⊥) in the radial direction in the section of a filament.

As shown in FIG. 1, the cooling chamber is arranged on both sides of the filament groups at a position by 300 mm directly below the spinning nozzle. The blow out zone length (l) is 70 mm and cooling air is uniformly blown from the cooling chamber to the filaments at a temperature of 13° C., a speed of 0.8 m/sec and a blow out angle of 35°.

Comparisons regarding the physical properties and the feature of the fine structure of the filaments constituting the web to be obtained by the method described hereinbefore are shown in Table 1. Examples 1 and 2 are the filament according to the first embodiment, and reference examples 3, 4, 5, and 6 are of the filaments which do not belong to the first embodiment. That is, in reference examples 3, 4, and 6, the filaments are produced by taking the predetermined. Spinning speed prepared by changing the H.D and the amount of the pressurized air of the air suction device, and reference example 5 is for a filament having an unsymmetrical construction produced by arranging the cooling chamber on only one side of the filament group.

Table 1 shows that the filaments constituting the nonwoven sheet according to the first embodiment expressed in examples 1 and 2 are satisfactory in average refractive index, thermal property and heat deterioration. Whereas the filaments expressed in reference examples 3 to 6, which do not belong to the first embodiment, are unsatisfactory in one or the other of the above mentioned properties.

B. The following three examples and a reference example regarding the polyethylene terephthalate filaments constituting the YW type nonwoven sheet according to the first embodiment and produced by using various cooling conditions are prepared and the various properties thereof are compared.

TABLE 1

| | | Example | | Reference Example | | | |
|---|---|---|---|---|---|---|---|
| | | 1 | 2 | 3 | 4 | 5 | 6 |
| Spinning Speed (m/min) | | 3000 | 3500 | 1300 | 5200 | 3000 | 3000 |
| H · D (mm) | | 600 | 400 | 5000 | 400 | 600 | 2000 |
| Refractive Index | $\Delta n$ ($\times 10^{-3}$) | 40 | 56 | 10 | 102 | 40 | 37 |
| | n \|\| (0) | 1.600 | 1.624 | 1.528 | 1.662 | 1.603 | 1.596 |
| | n \|\| (0.8)–n \|\| (0) ($\times 10^{-3}$) | 6.5 | 7.7 | 1.0 | 8.4 | 6.2 | 3.2 |
| | Distribution of Refractive Index | Symmetrical | Symmetrical | Symmetrical | Symmetrical | Unsymmetrical | Symmetrical |
| Thermal Property | Shrinkage Ratio (%) In Boiling Water | 46 | 21 | 36 | 3 | 49 | 51 |
| Mechanical Property | Tenacity (g/d) | 2.1 | 2.6 | 0.9 | 3.3 | 1.7 | 2.0 |
| | Elongation (%) At Break Point | 220 | 165 | 450 | 70 | 196 | 230 |
| Heat Deterioration | HR-1 (%) | 80 | 86 | 10 | 91 | 46 | 54 |
| | HR-2 (%) | 64 | 71 | 4 | 87 | 42 | 41 |

To produce the above examples and reference examples, the same polyethylene terephthalate as that in A is spun at the same spinning temperature by the same spinning unit. However, the distance between the spinning nozzle and the air suction device is determined as 80 mm in this case, and various type webs are formed on the metal net by changing the spinning speed. In this embodiment, the cooling air at the above temperature blown at an angle of 5° and at a speed of 1.0 m/sec uniformly from a cooling air chamber arranged on both sides of the filament group in a position 200 mm directly below the spinning nozzle onto the filaments under a condition wherein the blow out zone length (L) is 70 mm and the blow out angle ($\theta$) is 35°.

Comparisons regarding the physical properties and features of the fine structure of the filaments constituting the web to be obtained by the method described hereinbefore are shown in Table 2. Examples 101 to 103 are the filaments according to the first embodiment and reference example 104 is for the filaments which do not belong to the first embodiment.

Table 2 shows that the filaments constituting the nonwoven sheet according to the first embodiment expressed in examples 101 to 103 have a satisfactory average refractive index, thermal property, and heat deterioration. Whereas the filament expressed in reference example 104, which do not belong to the first embodiment, is unsatisfactory in one or the other of the above mentioned properties. As can be easily seen by comparing Table 2 with Table 1, the filament having a clear two ply construction and a more improved heat deterioration can be obtained by selecting the optimum cooling condition.

TABLE 2

| | | Example | | | Reference Example |
|---|---|---|---|---|---|
| | | 101 | 102 | 103 | 104 |
| Spinning Speed (m/min) | | 2500 | 3000 | 3500 | 1500 |
| Refractive Index | $\Delta n$ ($\times 10^{-3}$) | 22 | 33 | 44 | 8 |
| | n \|\| (0) | 1.591 | 1.604 | 1.618 | 1.568 |
| | n \|\| (0.8)–n \|\| (0) ($\times 10^{-3}$) | 8.1 | 9.5 | 10.8 | 3.0 |
| | Distribution of Refractive Index | Symmetry | Symmetry | Symmetry | Symmetry |
| Thermal Property | Shrinkage Ratio (%) In Boiling Water | 63 | 56 | 31 | 49 |

TABLE 2-continued

| | | Example | | | Reference Example |
|---|---|---|---|---|---|
| | | 101 | 102 | 103 | 104 |
| Mechanical Property | Tenacity (g/d) | 1.8 | 2.0 | 2.4 | 0.9 |
| | Elongation (%) At Break Point | 220 | 176 | 136 | 340 |
| Heat Deterioration | HR-1 (%) | 75 | 84 | 89 | 12 |
| | HR-2 (%) | 63 | 71 | 80 | 8 |

C. Various nonwoven sheets are produced by heat-press-bonding the webs obtained in A and the properties of each nonwoven sheet are compared.

That is, each nonwoven web having the weight per unit area of about 100 g/m$^2$ and consisting of the filaments of examples 1 and 2 and reference examples 3 to 6 are heat-press-bonded by a pair of rolls, in which the top roll is an embossing roll having a plurality of convex portions arranged uniformly on a surface thereof and in which the bottom roll has a smooth surface. The ratio of the heat-press-bonding portion (designated as heat-press-bond ratio) is 12%, the temperature of both roll is 110° C., and the linear pressure is 20 Kg/cm in the heat-press-bonding. However, the web in example 4 is heat-press-bonded by means of rolls having a temperature of 235° C.

The properties of the filaments constituting the nonwoven sheets produced in these examples and the mechanical properties, heat deterioration and abrasion resistance of the nonwoven sheets are shown in the Table 3. Examples 11 and 12 are nonwoven sheets produced by the webs according to the first embodiment, respectively, and reference examples 13 to 16 are the nonwoven sheet produced by the webs which do not belong to the first embodiment, respectively.

Table 3 shows that the nonwoven sheets of examples 11 and 12 according to the first embodiment have high elongation, improved heat deterioration, and good abrasion resistance, respectively. Whereas, the nonwoven sheets expressed in reference examples 13 to 16, which do not belong to the first embodiment, are unsatisfactory in one or the other of the above mentioned properties.

TABLE 3

| | | | | Example | | Reference Example | | | |
|---|---|---|---|---|---|---|---|---|---|
| | | | | 11 | 12 | 13 | 14 | 15 | 16 |
| Properties of Filament in Nonwoven Sheet | Refractive Index | $\Delta n$ ($\times 10^{-3}$) | | 43 | 60 | 11 | 125 | 44 | 42 |
| | | n \|\| (0) | | 1.607 | 1.630 | 1.530 | 1.693 | 1.609 | 1.605 |
| | | n \|\| (0.8)–n \|\| (0) ($\times 10^{-3}$) | | 6.5 | 7.6 | 0.9 | 7.8 | 6.4 | 3.3 |
| | | Distribution of Refractive Index | | Symmetry | Symmetry | Symmetry | Symmetry | Unsymmetry | Symmetry |
| | Thermal Property | Shrinkage Ratio (%) In Boiling Water | | 44 | 20 | 30 | 1 | 45 | 46 |
| | Mechanical Property | Tenacity (g/d) | | 2.0 | 2.4 | 0.4 | 3.2 | 1.6 | 1.9 |
| | | Elongation (%) At Break Point | | 197 | 146 | 32 | 67 | 165 | 176 |
| Property of Nonwoven Sheet | Mechanical Property | Strength (Kg/3 cm) | W | 9.8 | 12.5 | 4.3 | 16.4 | 9.5 | 8.9 |
| | | | F | 5.2 | 7.6 | 2.6 | 10.2 | 5.3 | 5.0 |
| | | Elongation (%) | W | 135 | 105 | 56 | 24 | 126 | 131 |
| | | At Breakage | F | 125 | 100 | 22 | 28 | 118 | 115 |
| | | Tear Strength (Kg) | W | 5.3 | 5.5 | 0.3 | 1.2 | 5.3 | 5.4 |
| | | | F | 4.2 | 4.6 | 0.1 | 0.4 | 4.3 | 4.4 |
| | Heat Deterioration | HR-2 (%) | W | 77 | 80 | 16 | 98 | 54 | 36 |
| | | | F | 75 | 83 | 13 | 98 | 51 | 39 |

Remarks
W: the lengthwise direction of the sheet
F: the widthwise direction of the sheet D. Various nonwoven sheets are produced by needle punching the webs obtained in A and the properties of each nonwoven sheet are compared.

At first, each web of the examples 1 and 2 and the reference examples 3 to 6 are needle punched, respectively. A No. 40 needle, a needle pricking depth of 13 mm, and a number of needle punching of 100 punches/cm$^2$ are used for the needle punching process.

The mechanical properties and heat deterioration of the nonwoven sheet produced in these examples are shown in Table 4. Examples 21 and 22 are the nonwoven sheets according to the first embodiment, respectively and reference examples 22 to 26 are the nowoven sheets which do not belong to the first embodiment, respectively. Incidentally, since the nonwoven sheets of these examples are produced without heat treatment, properties of filaments in the nonwoven sheets are the same as the properties of filaments described in Table 1. Therefore, numeral values regarding the properties of filaments in the nonwoven sheets of these examples are omitted from Table 4.

Table 4 shows that the nonwoven sheets of examples 21 and 22 according to the first embodiment have high elongation and improved heat deterioration. Whereas, the nonwoven sheets expressed in reference examples 23 to 26, which do not belong to the first embodiment, are unsatisfactory in one or the other of the above mentioned properties.

TABLE 4

| | | | Example | | Reference Example | | | |
|---|---|---|---|---|---|---|---|---|
| | | | 21 | 22 | 23 | 24 | 25 | 26 |
| Mechanical Property | Strength (Kg/3 cm) | W | 8.6 | 10.2 | 5.5 | 17.1 | 8.3 | 7.9 |
| | | F | 4.7 | 6.3 | 4.0 | 8.6 | 4.8 | 4.5 |
| | Elongation (%) At Break Point | W | 110 | 105 | 65 | 60 | 106 | 102 |
| | | F | 135 | 115 | 85 | 105 | 127 | 111 |
| Heat Deterioration | HR-2 (%) | W | 76 | 78 | 12 | 83 | 49 | 31 |
| | | F | 73 | 77 | 9 | 81 | 44 | 32 |

E. Various YH type nonwoven sheets according to the second invention are produced from the webs consisting of the filaments obtained in A (including the two examples and the four reference examples) and the properties of each nonwoven sheet are compared.

That is, each web consisting of filaments having the properties described in Table 1 are heat-press-bonded to entangle the filaments together. The heat-press-bonding is performed between a top embossing roll having a plurality of concave portions and a bottom roll having a smooth surface. A heat-press-bond ratio of 12%, a temperature of both roll of 120° C., and a linear pressure of 20 Kg/cm are used in the heat-press-bonding.

The above nonwoven sheets are heat treated at a temperature of 180° C. and constant extension for 30 sec by means of a tenter machine.

The properties of the nonwoven sheets and the filaments constituting the nonwoven sheets and the heat deterioration are shown in Table 5. Note, reference 34 is a well-known filament nonwoven sheet heat-press-bonded by using the top and bottom rolls at a temperature of 230° C.

Table 5 shows that the nonwoven sheets having the large value of $\{n \parallel (0.8) - n \parallel (0)\}$ are not easily deteriorated by heat and are not easily shrunk by heat. That is, the nonwoven sheets of examples 31 and 32 satisfy the requirements regarding the refractive index, i.e., $1.600 \leqq n \parallel (0) \leqq 1.670$ $$\{n \parallel (0.8) - n \parallel (0)\} \geqq 5 \times 10^{-3}.$$

Further, the heat shrinkage ratio of the above nonwoven sheets is at most 5% and nearly equal to zero. The elongation retention ratio of the above nonwoven sheet is at least 70% at 150° C.

TABLE 5

| | | Properties of Filament in Nonwoven Sheet | | | Property of Nonwoven Sheet | | | | | | | | |
|---|---|---|---|---|---|---|---|---|---|---|---|---|---|
| | | | | | Strength (kg/3 cm) | | Elongation At Break Point (%) | | Heat Shrinkage Ratio (%) | | Abrasion Resistance | Heat Deterioration (%) HR-2 | |
| | | Δn ×10⁻³ | n ‖ (0) | {n ‖ (0.8)−n ‖ (0)} ×10⁻³ | W | F | W | F | W | F | (Grade) | W | F |
| Example | 31 | 58 | 1.638 | 6.6 | 10.8 | 6.6 | 115 | 65 | 0 | 0 | A | 77 | 75 |
| | 32 | 87 | 1.662 | 7.5 | 12.4 | 7.2 | 60 | 53 | 1 | 1 | A | 80 | 83 |
| Reference Example | 33 | 24 | 1.565 | 0.8 | 4.5 | 3.0 | 8 | 11 | 0 | 0 | A | 25 | 20 |
| | 34 | 131 | 1.696 | 8.0 | 18.8 | 13.8 | 17 | 26 | 0 | 0 | B | 98 | 98 |
| | 35 | 61 | 1.640 | 6.4 | 9.4 | 6.1 | 106 | 57 | 0 | 0 | A | 66 | 62 |
| | 36 | 56 | 1.637 | 3.6 | 9.2 | 5.9 | 98 | 57 | 0 | 0 | A | 43 | 48 |

This means that the filaments used in the above nonwoven sheet are those which the heat deterioration is low.

Whereas, reference example 33 shows the nonwoven sheet having a low strength and elongation at break point and inferior heat deterioration, reference example 34 shows the nonwoven sheet having a high strength and a low abrasion resistance, and reference examples 35 and 36 show the nonwoven sheet having an inferior heat deterioration. The nonwoven sheets of the above four reference examples do not have the total or balanced properties obtained by the nonwoven sheets according to the second embodiment.

The relationship between stress and strain, measured in an atmosphere of 150° C., of the nonwoven sheets of examples 31 and 32 and reference example 34 is shown in Table 6. As can be seen from Table 6, the nonwoven sheets according to the second embodiment have a low initial modulus, which means that the heat molding property of those nonwoven sheet is good. Further since those nonwoven sheets have an elongation of at least 70% at 150° C., they can be used as a molding material capable of withstanding a molding process using a relatively large convex portion or concave portion.

Whereas, the elongation of breakage of the nonwoven sheet of reference 34 is extremely low at a temperature of 150° C., and therefore, the molding ability of this nonwoven sheet is very weak.

TABLE 6

| | | Intermediate Stress in the Atmosphere of 150° C. (Kg/3 cm) | | | | | | | | | | | | | | | |
|---|---|---|---|---|---|---|---|---|---|---|---|---|---|---|---|---|---|
| | | 10% | | 20% | | 30% | | 40% | | 50% | | 70% | | 90% | | 110% | |
| | | W | F | W | F | W | F | W | F | W | F | W | F | W | F | W | F |
| Example | 31 | 0.7 | 0.6 | 1.2 | 1.1 | 1.7 | 1.6 | 2.4 | 2.4 | 3.1 | 3.1 | 4.2 | 4.3 | 5.4 | 5.5 | 6.6 | 6.7 |
| | 32 | 0.8 | 0.6 | 1.3 | 1.2 | 1.9 | 1.7 | 2.6 | 2.5 | 3.3 | 3.2 | 4.3 | 4.2 | 5.6 | 5.6 | 6.8 | 6.8 |
| Reference Example | 34 | 7.9 | 4.4 | 13.1 | 7.4 | 17.3 | 10.1 | | | | | | | | | | |

Remarks:
The nonwoven sheet of reference example 34 breaks at 30% elongation in the lengthwise direction and at 36% elongation in the widthwise direction.

F. Various YN type nonwoven sheets according to the third embodiment are produced from the webs consisting of the filaments obtained in A (including the two examples and the four reference examples) and the properties of each nonwoven sheet are compared.

That is, in this embodiment, two examples according to the third embodiment, i.e., examples 41 and 42, and four reference examples, i.e., reference examples 43~46, are prepared and the properties of the filaments constituting the nonwoven sheets and the nonwoven sheets themself are compared in the state wherein intermediate goods are produced by partially heat-press-bonding each web consisting of filaments having the properties described in the Table 1 and then are needle punched, and nonwoven sheets according to the third embodiment is produced by heat shrinking the above mentioned intermediate goods, respectively.

To obtain the above mentioned intermediate goods, each web having the weight per unit area of 100 g/m$^2$ in the A is heat-press-bonded at a temperature of 60° C. and a linear pressure 20 Kg/cm by means of a pair of rolls consisting of an embossing roll having a heat press ratio of 12% and a smooth roll and being needle punched at a needle pricking depth of 15 mm and a needle punching number of 300 punches/cm$^2$ by using a needle No. 40.

The properties of the filaments constituting the intermediate goods and the intermediate goods per se are shown in Table 7. Examples 41a, 42a and reference examples 43a to 46a in Table 7 are further heat shrunk and become examples 41 and 42 and reference examples 43 to 46, respectively.

The above mentioned heat shrinking treatment is performed at a temperature of 100° C. and a treatment time of 30 sec by means of a pinter machine adjusted so that the nonwoven sheets can be shrunk by 30% in both the lengthwise direction and the widthwise direction.

Note, the reference sample 44 is produced by shrinking the nonwoven sheet at a temperature of 100° C. and a treatment time of 30 sec without shrinkage of the nonwoven sheet.

The properties of the filaments constituting the nonwoven sheets according to the third embodiment and the nonwoven sheets per se are shown in Table 8.

Table 8 shows that the nonwoven sheets of examples 41 and 42 according to the third embodiment have a fine filament density and are a bulky nonwoven sheet having a satisfactory elastic recovery ratio, rigidity and softness, dust catching ratio, and anisotropy of elongation against an outer force. Whereas, the nonwoven sheet of reference samples 43.44 do not satisfy the object of the third embodiment as shown in Table 8. Regarding the properties described in Table 8, the nonwoven sheets of reference examples 45 and 46 have similar properties to those of the nonwoven sheets of examples 41 and 42.

A heat deterioration test (HR-2) is applied to the nonwoven sheets of examples 41 and 42 and reference examples 43 to 46. The results thereof are shown in Table 9. Table 9 shows that the decrease of the elongation at breakage of the nonwoven sheets of examples 41 and 42 according to the third embodiment is low, respectively. This means that the heat deterioration is widely improved in the nonwoven sheet according to the third embodiment. In reference examples 45 and 46, the elongation at breakage decreases widely and the strength also decreases. This means that the nonwoven sheets of the reference examples have a remarkably inferior heat deterioration. Note, as shown in Table 9, in the nonwoven sheets according to the third embodiment, the strength is increased in the heat deterioration. This phenomenon is caused by an increment of the entanglement between filaments to which heat-pressing is applied by means of smooth rolls.

TABLE 7

| | | | | Properties of Filament | | | Properties of Intermediate Nonwoven Sheet | | | | | |
|---|---|---|---|---|---|---|---|---|---|---|---|---|
| | | Spinning Speed (m/min) | H · D (mm) | Average Refractive Index n ‖ (0) | {n ‖ (0.8–n ‖ (0)} ×10$^{-3}$ | Distribution of n ‖ (0) | Weight per unit area (g/m$^2$) | Thickness (mm) | Strength (kg/3 cm) W | Strength (kg/3 cm) F | Elongation (%) At Break Point W | Elongation (%) At Break Point F |
| Example | 41a | 3000 | 600 | 1.600 | 6.5 | Symmetry | 100 | 0.9 | 9 | 5 | 110 | 135 |
| | 42a | 3500 | 400 | 1.624 | 7.7 | Symmetry | 100 | 0.9 | 10 | 6 | 105 | 115 |
| Reference Example | 43a | 1300 | 5000 | 1.528 | 1.0 | Symmetry | 100 | 0.6 | 4 | 3 | 65 | 85 |
| | 44a | 5200 | 400 | 1.662 | 8.4 | Symmetry | 100 | 0.6 | 17 | 8 | 60 | 105 |
| | 45a | 3000 | 600 | 1.603 | 6.2 | Unsymmetry | 100 | 0.9 | 8 | 5 | 95 | 113 |
| | 46a | 3000 | 2000 | 1.596 | 3.2 | Symmetry | 100 | 0.9 | 9 | 5 | 101 | 126 |

TABLE 8

| | | Properties of Filament | | Properties of Nonwoven Sheet | | | |
|---|---|---|---|---|---|---|---|
| | | Average Refractive Index n (0) | {n ‖ (0.8)–n ‖ (0)} ×10$^{-3}$ | Weight per Unit Area (g/m$^2$) | Thickness (mm) | Bulkiness (cm$^3$/g) | Dust Catching Ratio (%) |
| Example | 41 | 1.627 | 6.3 | 200 | 1.4 | 7.0 | 90 |
| | 42 | 1.653 | 7.1 | 180 | 1.5 | 8.3 | 88 |
| Reference Example | 43 | 1.551 | 0.5 | 195 | 0.9 | 4.6 | 95 |
| | 44 | 1.680 | 7.7 | 103 | 0.6 | 6.0 | 45 |
| | 45 | 1.624 | 6.0 | 203 | 1.3 | 6.4 | 92 |
| | 46 | 1.620 | 3.1 | 205 | 1.3 | 6.4 | 90 |

| | | Properties of Nonwoven Sheet | | | | | | | | | | | | |
|---|---|---|---|---|---|---|---|---|---|---|---|---|---|---|
| | | Rigidity and Softness (cm) | | Strength (kg/3 cm) | | Elongation At Break Point (%) | | Heat Shrinkage Ratio (%) | | Elastic Recovery Ratio (%) | | Anisotropy | | |
| | | W | F | W | F | W | F | W | F | W | F | 10% | 20% | 30% |
| Example | 41 | 5.5 | 5.0 | 14.5 | 12.6 | 105 | 115 | 2 | 1 | 85 | 83 | 1.3 | 1.5 | 1.6 |

TABLE 8-continued

| | | | | | | | | | | | | | | |
|---|---|---|---|---|---|---|---|---|---|---|---|---|---|---|
| | 42 | 4.0 | 4.0 | 16.1 | 14.2 | 115 | 120 | 1 | 1 | 90 | 85 | 1.5 | 1.7 | 1.9 |
| Reference | 43 | >15 | >15 | 6.7 | 4.5 | 35 | 32 | 2 | 2 | 30 | 25 | 2.0 | 2.5 | 3.0 |
| Example | 44 | 7.0 | 6.5 | 17.4 | 6.2 | 60 | 105 | 0 | 0 | 45 | 30 | 7.0 | 8.5 | 10.0 |
| | 45 | 6.1 | 5.4 | 13.7 | 11.5 | 89 | 94 | 2 | 1 | 75 | 73 | 1.2 | 1.4 | 1.5 |
| | 46 | 5.7 | 5.3 | 14.2 | 12.0 | 93 | 104 | 2 | 1 | 80 | 76 | 1.3 | 1.5 | 1.6 |

TABLE 9

| | | Nonwoven Sheet before heat Deteriorating Treatment | | | | Nonwoven Sheet after Heat Deteriorating Treatment | | | |
|---|---|---|---|---|---|---|---|---|---|
| | | Strength (kg/3 cm) | | Elongation at Break Point (%) | | Strength (kg/3 cm) | | Elongation at Break Point (%) | |
| | | W | F | W | F | W | F | W | F |
| Example | 41 | 14.5 | 12.6 | 105 | 115 | 20.3 | 13.9 | 85 | 100 |
| | 42 | 16.1 | 14.2 | 115 | 120 | 17.0 | 11.4 | 95 | 105 |
| Reference | 43 | 6.7 | 4.5 | 35 | 32 | 3.4 | 2.1 | 5 | 7 |
| Example | 44 | 17.4 | 6.2 | 60 | 105 | 17.1 | 5.5 | 50 | 85 |
| | 45 | 13.7 | 11.5 | 89 | 94 | 11.6 | 9.2 | 43 | 54 |
| | 46 | 14.2 | 12.0 | 93 | 104 | 10.5 | 8.3 | 36 | 46 |

Since the YN type nonwoven sheet according to the first embodiment is produced from polyethylene terephthalate filaments having the constitution described hereinbefore, this nonwoven sheet has an improved heat deterioration, and a high elongation and heat shrinkable property. Therefore this nonwoven sheet can be used for end uses requiring heat shrinkage.

In the YH type nonwoven sheet according to the second embodiment fuzzing and an exfoliation between layers does not easily occur in the nonwoven sheet, the sheet can be easily stretched, and there is a small heat shrinkage. Therefore, this nonwoven sheet has a superior ability when it is used to make heat molding goods having a large amount of transformation.

The YN type nonwoven sheet according to the third embodiment has a fine filament density, a high elastic recovery and an improved anisotropy of elongation against outside force. Therefore, this nonwoven sheet has a superior ability in fields in which only known nonwoven sheets could be used, due to their unsufficient properties, i.e., for felt like goods.

We claim:

1. A nonwoven sheet composed of polyethylene terephthalate filaments, wherein the filaments have an elongation at breakage of at least 100%, a shrinkage in boiling water of at least 15%, the filament section is a circular section having a radius R, and the average refractive index n || 0) of the central portion of the filament section and the average refractive index n || (0.8) of the portion apart by 0.8R from the center satisfy the following requirements:

$$n \parallel (0) \leqq 1.640 \text{ and } [n \parallel (0.8) - n \parallel (0)] \geqq 6 \times 10^{-3}.$$

2. A nonwoven sheet as set forth in claim 1, wherein distribution of a partial average refractive index is symmetrical about the center of a filament section.

3. A nonwoven sheet as set forth in claim 1, wherein the fineness of the polyethylene terephthalate filaments is at most 30 denier.

4. A nonwoven sheet as set forth in claim 1, wherein the fineness of the plyethylene terephthalate filaments is 0.5 to 15 denier.

5. A nonwoven sheet as set forth in claim 1, wherein plural kinds of polyethylene terephthalate filaments having different fineness are used.

6. A nonwoven sheet as set forth in claim 1, wherein the weight per unit area is 10 to 500 g/m$^2$.

7. A nonwoven sheet composed of polyethylene terephthalate filaments partially heat-press-bonded to one another, wherein the heat shrinkage at 150° C. is at most 5% and the elongation at breakage at 150° C. is at least 70%, and wherein the filaments have a circular section having a radius R, and the average refractive index n || (0) of the central portion of the filament section and the average refractive index n || (0.8) of the portion apart by 0.8R from the center satisfy the following requirements:

$$1.600 \leqq n \parallel (0) \leqq 1.670 \text{ and } [n \parallel (0.8) - n \parallel (0)] \geqq 5 \times 10^{-3}.$$

8. A nonwoven sheet as set forth in claim 7, wherein a distribution of said partial average refractive index is symmetrical about the center of said filament section.

9. A nonwoven sheet as set forth in claim 7, wherein the fineness of the polyethylene terephthalate filaments is at most 30 denier.

10. A nonwoven sheet as set forth in claim 7, wherein the fineness of the polyethylene terephthalate filaments is 0.5 to 15 denier.

11. A nonwoven sheet as set forth in claim 7, wherein plural kinds of polyethylene terephthalate filaments having a different fineness are used.

12. A nonwoven sheet as set forth in claim 7, wherein the weight per unit area is 10 to 500 g/m$^2$.

13. A nonwoven sheet as set forth in claim 7, wherein the ratio of the heat-press bonded area to the total area is 5 to 50%.

14. A nonwoven sheet composed of polyethylene terephthalate filaments mechanically interlaced with one another by needle punching, wherein the heat shrinkage at 150° C. is at most 5%, the filament density is such that the ratio of caught particles having a size larger than 15$\mu$ is at least 80%, and the elastic recovery is at least 50%, and wherein the filaments have a circular section having a radius R, and the average refractive index n || (0) of the central portion of the filament section and the average refractive index n || (0.8) of the portion apart by 0.8R from the center satisfy the following requirements:

$$1.600 \leqq n \parallel (0) \leqq 1.670 \text{ and } [n \parallel (0.8) - n \parallel (0)] \geqq 5 \times 10^{-3}.$$

15. A nonwoven sheet as set forth in claim 14, wherein the distribution of said partial average refractive index is symmetrical about the center of said filament section.

16. A nonwoven sheet as set forth in claim 14, wherein the fineness of the polyethylene terephthalate continuous filaments is at most 30 denier.

17. A nonwoven sheet as set forth in claim 14, wherein the fineness of the polyethylene terephthalate continuous filaments is 0.5 to 15 denier.

18. A nonwoven sheet as set forth in claim 14, wherein plural kinds of polyethylene terephthalate continuous filaments having a different fineness are used.

19. A nonwoven sheet as set forth in claim 14, wherein the weight per unit area is 10 to 500 $g/m^2$.

20. A nonwoven sheet as set forth in claim 14, wherein the punching frequency at the needle punching is at least 50 $punches/cm^2$.

21. A nonwoven sheet as set forth in claim 14, wherein the punching frequency at the needle punching is 100 to 500 $punches/cm^2$.

* * * * *